US008242967B2

(12) United States Patent
Jiang et al.

(10) Patent No.: US 8,242,967 B2
(45) Date of Patent: Aug. 14, 2012

(54) MULTIPLE-INPUT MULTIPLE-OUTPUT DEVICE

(75) Inventors: Xue-Dong Jiang, Shanghai (CN); Su-Qin Li, Shanghai (CN); Jian-Feng Xiao, Shanghai (CN); Ming-Jiang Fan, Shanghai (CN)

(73) Assignees: Ambit Microsystems (Shanghai) Ltd., Shanghai (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 422 days.

(21) Appl. No.: 12/582,792

(22) Filed: Oct. 21, 2009

(65) Prior Publication Data

US 2010/0309086 A1 Dec. 9, 2010

(30) Foreign Application Priority Data

Jun. 5, 2009 (CN) ..... 2009 2 0304032

(51) Int. Cl.
*H01Q 1/52* (2006.01)
*H01Q 21/10* (2006.01)

(52) U.S. Cl. ..... 343/841; 343/846; 343/829; 343/853; 343/732; 343/867; 343/842

(58) Field of Classification Search ..... None
See application file for complete search history.

(56) References Cited

U.S. PATENT DOCUMENTS

| | | | | |
|---|---|---|---|---|
| 6,426,723 | B1 * | 7/2002 | Smith et al. | 343/700 MS |
| 6,535,170 | B2 * | 3/2003 | Sawamura et al. | 343/702 |
| 7,683,839 | B2 * | 3/2010 | Ollikainen et al. | 343/702 |
| 2004/0119654 | A1 * | 6/2004 | Koyama | 343/846 |
| 2006/0164320 | A1 * | 7/2006 | Lastinger et al. | 343/893 |
| 2007/0210968 | A1 | 9/2007 | Chung et al. | |
| 2007/0229364 | A1 * | 10/2007 | Shor | 343/700 MS |

* cited by examiner

*Primary Examiner* — Trinh Dinh
(74) *Attorney, Agent, or Firm* — Altis Law Group, Inc.

(57) ABSTRACT

A multiple-input multiple-output (MIMO) device includes a substrate, a shielding cover and a MIMO antenna. The shielding cover is positioned on the substrate, and includes a plurality of sidewalls. The MIMO antenna includes a first solid antenna, a second solid antenna, and a plane antenna. The first solid antenna and the second solid antenna are electrically connected to two ends of one sidewall of the shielding cover, respectively. The first plane antenna is configured on the substrate, and disposed between the first solid antenna and the second solid antenna.

14 Claims, 6 Drawing Sheets

MULTIPLE-INPUT MULTIPLE-OUTPUT DEVICE

RELATED APPLICATIONS

This application is based upon and claims the benefit of priority under 35 U.S.C. 119 from an application China 200920304032.5 filed on Jun. 5, 2009, the contents of which are incorporated herein by reference.

BACKGROUND

1. Technical Field

Embodiments of the present disclosure relate to electrical devices, and especially to a multiple-input and multiple-output (MIMO) device with a MOMO antenna.

2. Description of Related Art

MIMO antennas have attracted recent focus, due to increased throughput and transmission distance with no requirement for frequency band change or transmission power expenditure. The core value of MIMO antenna is increased transmission rate and communication quality using a plurality of antennas to send and receive electromagnetic signals.

The antenna includes inner and outer antennas. The inner antenna maintains device simple and compact in shape. However, design of an inner MIMO antenna to meet wireless device demands has proven a significant challenge in the industry.

DETAILED DESCRIPTION

Figure 1:
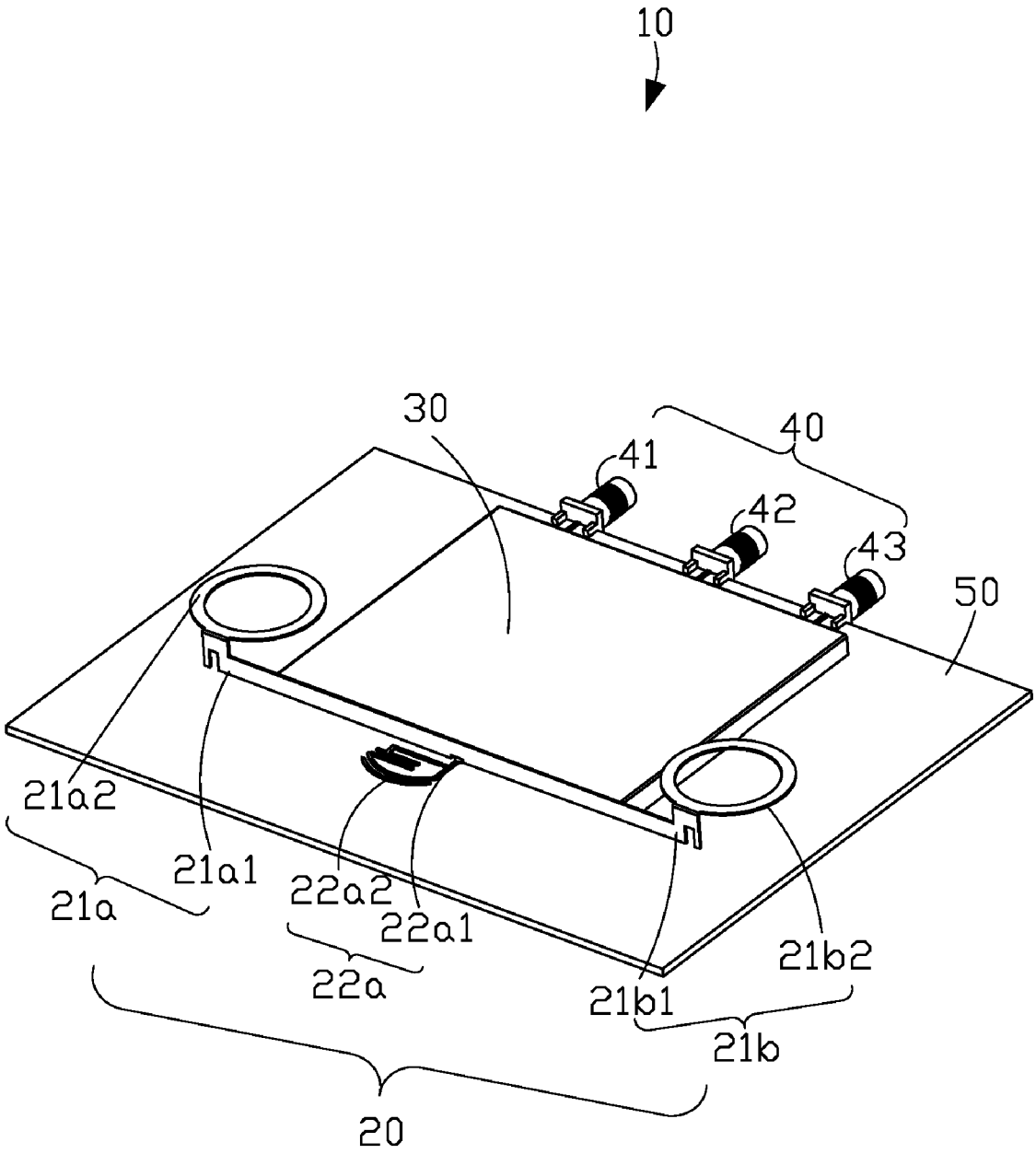
FIG. 1 is a schematic diagram of one embodiment of a MIMO device according to the present disclosure.
Figure 2:
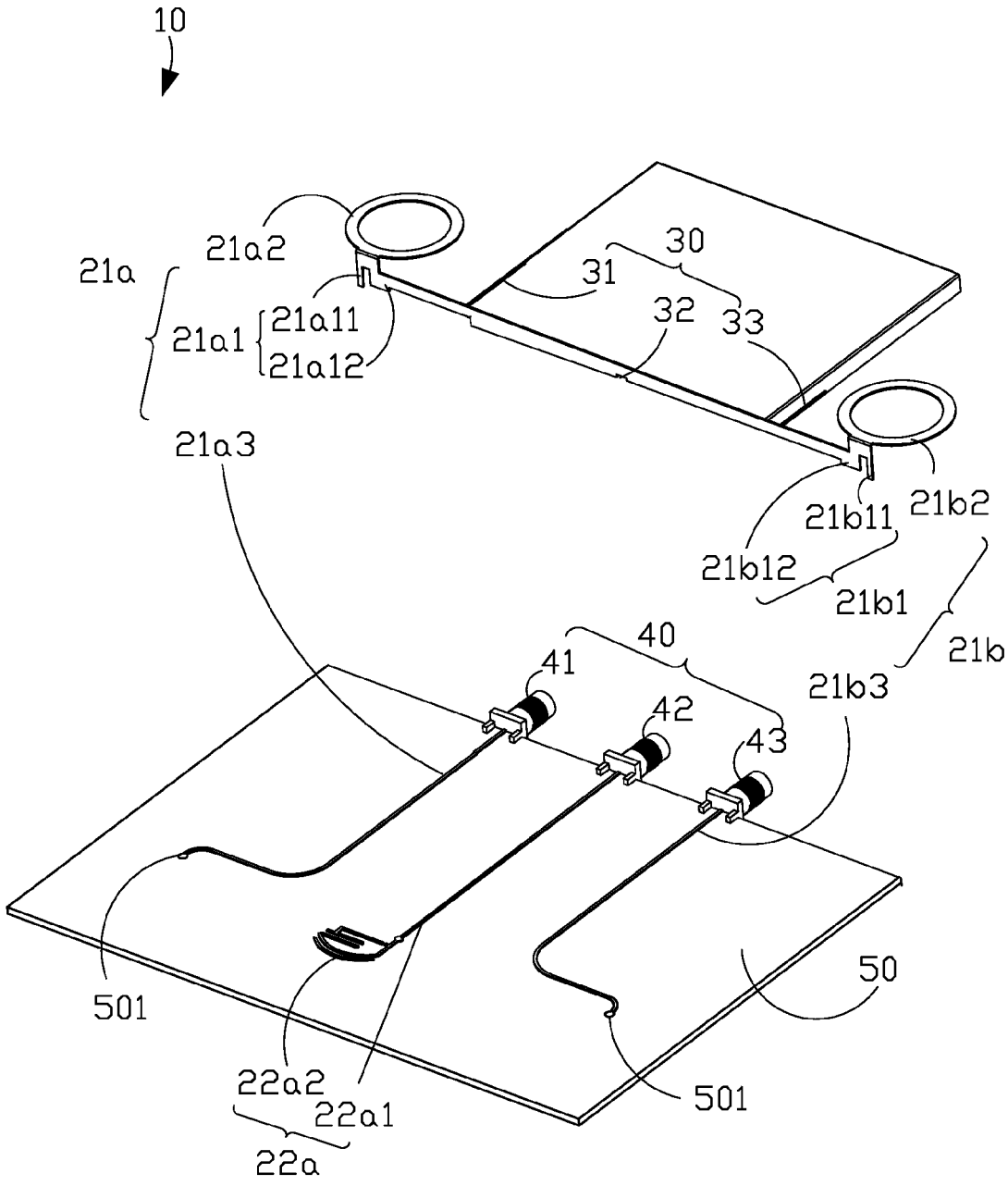
FIG. 2 is an exploded view of the MIMO device of FIG. 1.

Referring to FIG. 1 and FIG. 2, one embodiment of a multi-input multi-output (MIMO) device 10 is shown. The MIMO device 10 comprises a substrate 50, a connecting portion 40, a shielding cover 30, and a MIMO antenna 20.

The substrate 50 comprises a plurality of position throughways 501, to position the shielding cover 30 and the MIMO antenna 20.

The shielding cover 30 is configured on the substrate 50, and comprises a plurality of sidewalls. In one embodiment, the shielding cover 30 is rectangular, but may have other shapes such as polygonal. The shielding cover 30 further comprises a first feed throughway 31, a second feed throughway 32, and a third feed throughway 33. The first feed throughway 31, the second throughway 32 and the third feed throughway 33 are configured on the two ends and middle portion of the one sidewall of the shielding cover 30, respectively.

The MIMO antenna 20 is configured on the substrate 50, and comprises solid antennas 21 and plane antennas 22 disposed alternatively. In one embodiment, the MIMO antenna 20 comprises a first solid antenna 21*a*, a second solid antenna 21*b*, and a first plane antenna 22*a*. In one embodiment, the first solid antenna 21*a* and the second solid antenna 21*b* are configured on the same side of one sidewall of the shielding cover 30, and the first plane antenna 22*a* is on the opposite side of one sidewall of the shielding cover 30.

In one embodiment, the first solid antenna 21*a* and the second solid antenna 21*b* are electrically connected to two ends of one sidewall of the shielding cover 30, respectively. The first plane antenna 22*a* is configured on the substrate 50, and disposed between the first solid antenna 21*a* and the second solid antenna 21*b*. Partial enclosure of the shielding cover 30 by the MIMO antenna 20 can reduce volume of the MIMO device 10, and increase polarization effectiveness.

The first solid antenna 21*a* comprises a first connection section 21*a*1, a first solid radiator 21*a*2, and a first feed line 21*a*3.

The first feed line 21*a*3 is configured on the substrate 50, passing through the first feed throughway 31, to provide electromagnetic signals.

The first connection section 21*a*1 comprises a first feed end 21*a*11 and a first short end 21*a*12. The first feed end 21*a*11 connects the first solid radiator 21*a*2 to the first feed line 21*a*3, and passes through the positioning throughway 501 to position the first solid radiator 21*a*2. The first short end 21*a*12 connects the first solid radiator 21*a*2 to the shielding cover 30, to ground. In one embodiment, the first solid radiator 21*a*2, the first feed end 21*a*11, and the first short end 21*a*12 form a planar inverted F antenna (PIFA). In one embodiment, the first connection section 21*a*1 is connected to one end of one sidewall of the shielding cover 30. In one embodiment, the first solid radiator 21*a*2 is annular, to transceive the electromagnetic signals. In other embodiments, the first solid radiator may other shapes.

The second solid antenna 21*b* comprises a second feed line 21*b*3, a second connection section 21*b*1 and a second solid radiator 21*b*2. In one embodiment, the second solid antenna 21*b* is substantially symmetrical about the first solid antenna 21*a* in shape and structure.

The first plane antenna 22*a* is configured on the substrate 50, and comprises a first plane radiator 22*a*2 and a first feed portion 22*a*1. In one embodiment, the first feed portion 22*a*1 is elongated and connected to the second feed throughway 32, to supply the electromagnetic signals. The first feed portion 22*a*1 is perpendicular to one sidewall of the shielding cover 30. The first plane radiator 22*a*2 is grounded by coupling to one sidewall of the shielding cover 30. In one embodiment, the first plane radiator 22*a*2 is substantially G shaped to conserve space. In other embodiments, the first plane radiator 22*a*2 may other shapes.

In one embodiment, the connecting portion 40 comprises a first connector 41, a second connector 42, and a third connector 43. The first connector 41, the second connector 42, and the third connector 43 are configured on another sidewall of the shielding cover 30, and connect the MIMO antenna 20 to some electronic components, such as RF module, to transmit electromagnetic signals. In one embodiment, the first connector 41, the second connector 42, and the third connector 43 are connected to the first feed line 21*a*3, the first feed portion 22*a*1, and the second feed line 21*b*3, respectively.

Figure 3:
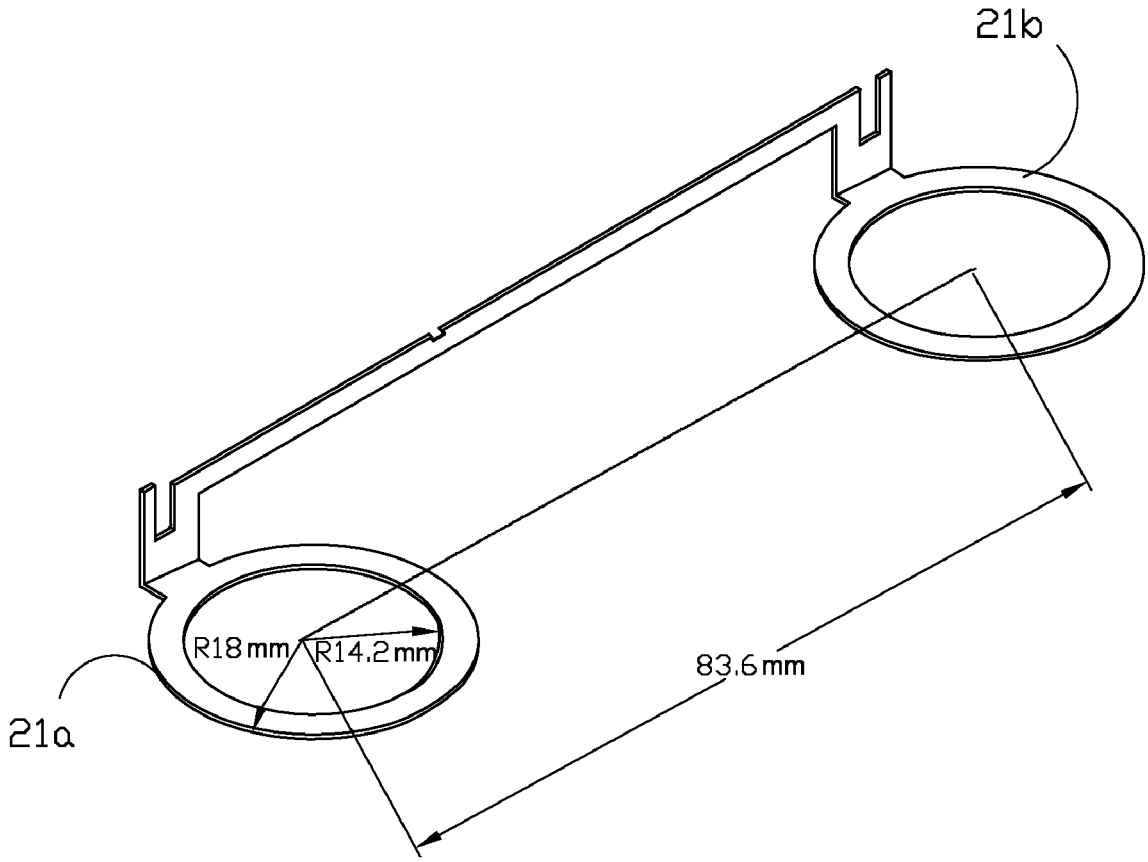
FIG. 3 is a local view of the MIMO device, illustrating dimensions of parts thereof.

Referring to FIG. 3, a local view and dimensions of parts of MIMO device 10 is shown. An inner radius and an outer radius of the first solid radiator 21*a*2 are approximately 14.2 mm and 18 mm, respectively. A distance between a center of the first radiator 21*a* and a center of the second radiator 21*b* is approximately 83.6 mm. It should be understood that the values disclosed above are exemplary and may differ depending on the embodiment.

Figure 4:
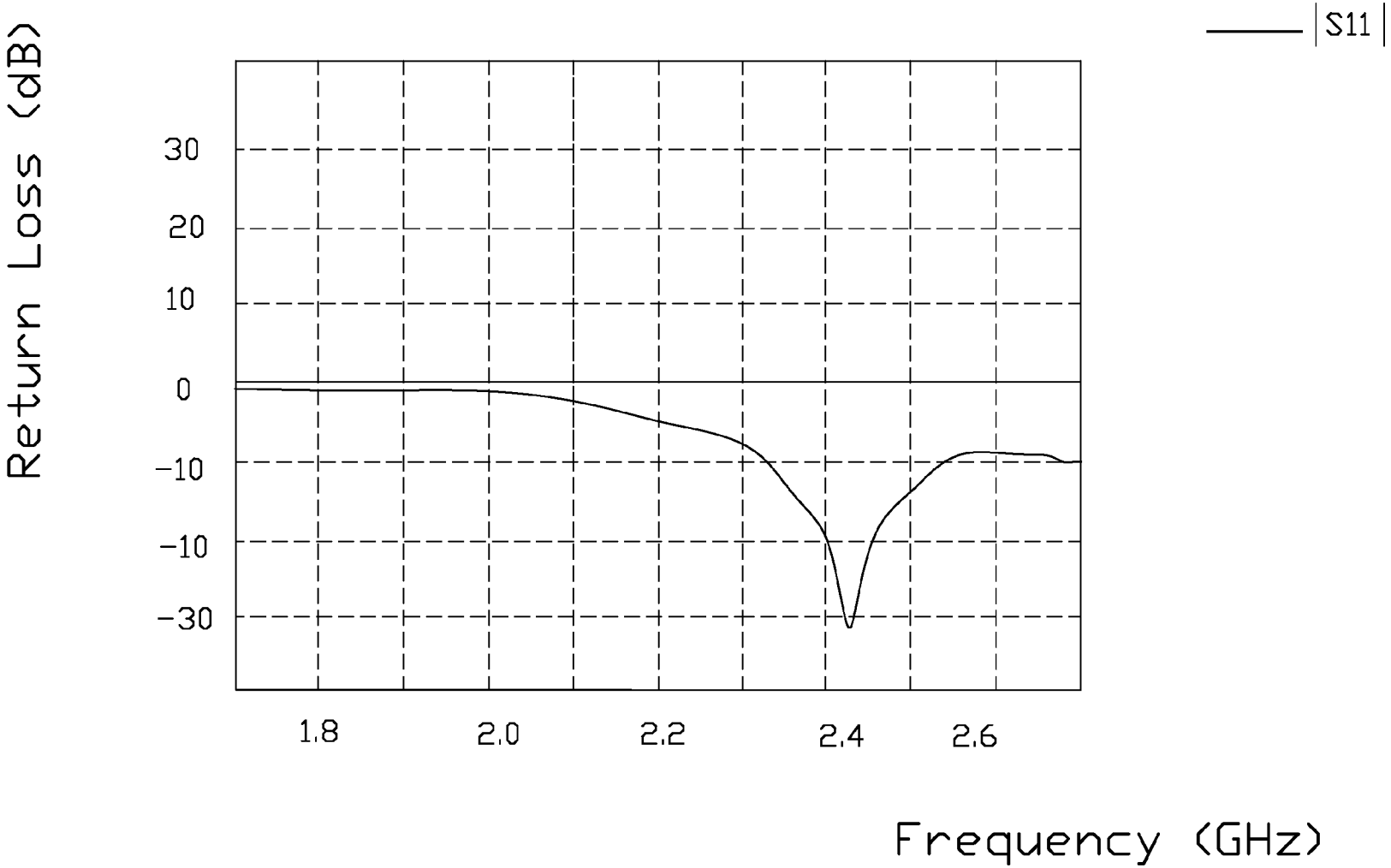
FIG. 4 is a graph showing one exemplary return loss of the MIMO device of FIG. 1.

FIG. 4 is a graph showing exemplary return loss of the MIMO device 10 of FIG. 1. As shown, the return loss is less than −10 dB, when the MIMO device 10 works in frequency bands from 2.4 GHZ to 2.5 GHz.

Figure 5:
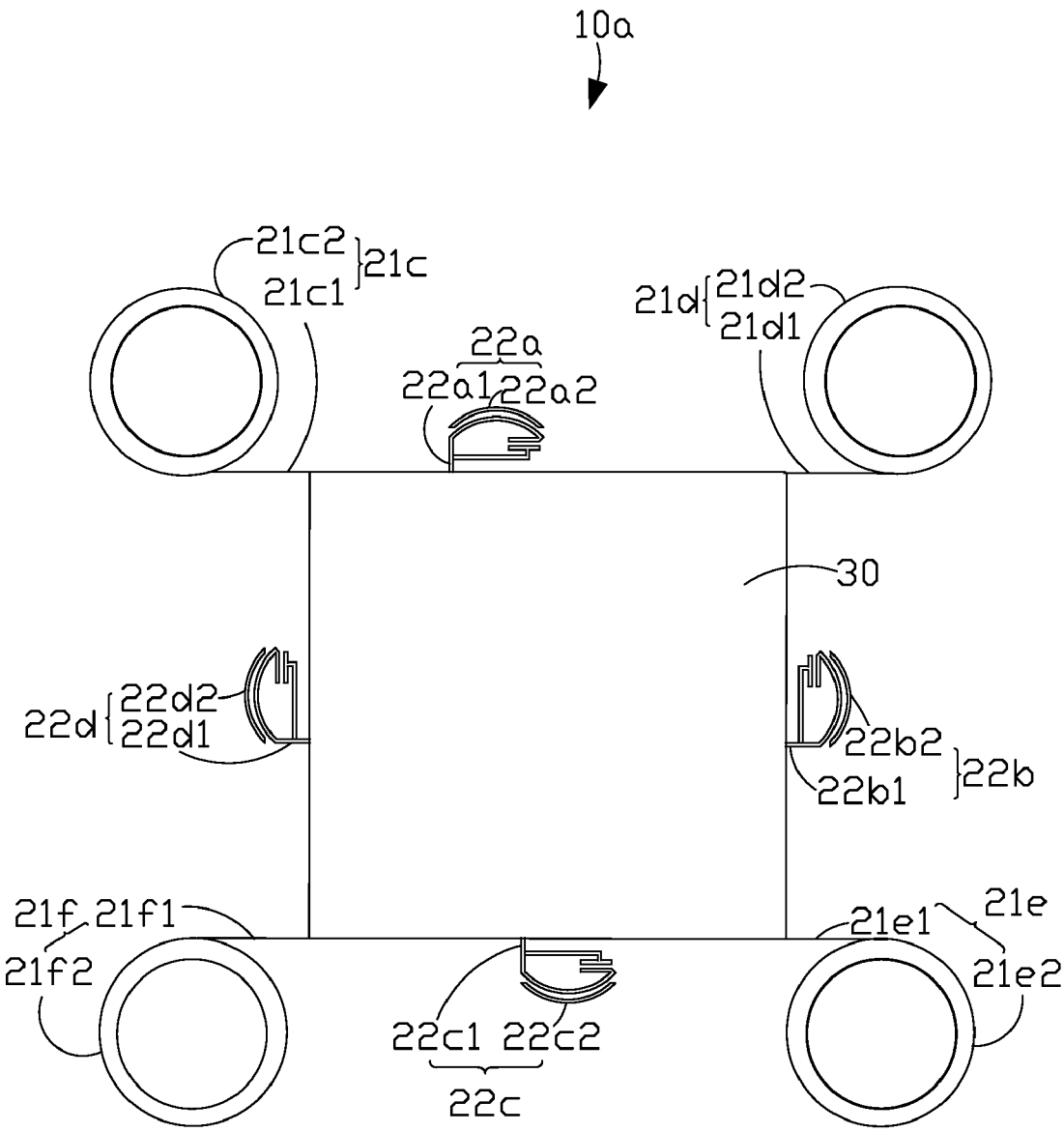
FIG. 5 is a schematic diagram of one embodiment of a MIMO device according to the present disclosure.

FIG. 5 is a schematic diagram of one embodiment of a MIMO device 10*a* according to the present disclosure, differing from the MIMO device 10 shown in FIG. 1 only in the further inclusion of a third solid antenna 21*e* and a fourth antenna 21*f*, and a plurality of plane antennas, such as 22*b*, 22*c* and 22*d*.

In one embodiment, the first solid antenna 21*c* and the second solid antenna 21*d* and the first plane antenna 22*a* are configured on the same sidewall of the shielding cover 30. The third solid antenna 21*e*, the fourth solid antenna 21*f* and one of the plurality of plane antennas 22*c* are connected to two ends of another sidewall of the shielding cover 30, respectively.

As shown in FIG. 2 and FIG. 5, the third solid antenna 21*e* and the fourth solid antenna 21*f* are the same as or substantially symmetrical to the first solid antenna 21*c* in shape and structure. In one embodiment, the third solid antenna 21*e* comprises a third solid radiator 21*e*2, a third connection section 21*e*1, and a third feed line, the fourth solid antenna 21*f* comprises a fourth solid radiator 21*f*2, a fourth connection section 21*f*1, and a fourth feed line.

A second plane antenna 22*b*, a third plane antenna 22*c* and a fourth plane antenna 22*d* are the same as or substantially symmetrical to the first plane antenna 22*a* in shape and structure. In one embodiment, all the plane antennas, such as 22*a*, 22*b*, 22*c* and 22*d*, are configured on the middle portions of different sidewalls of the shielding cover 30, respectively. The second plane antenna 22*b* comprises a second feed portion 22*b*1 and a second plane radiator 22*b*2. The third plane antenna 22*c* comprises a third feed portion 22*c*1 and a third plane radiator 22*c*2. The fourth plane antenna 22*d* comprises a fourth feed portion 22*d*1 and a fourth plane radiator 22*d*2.

In one embodiment, the shielding cover 30 further comprises a plurality of feed throughways, accepting passage therethrough of the feed portions of the plane antennas 22, and feed line of the solid antennas 21.

Figure 6:
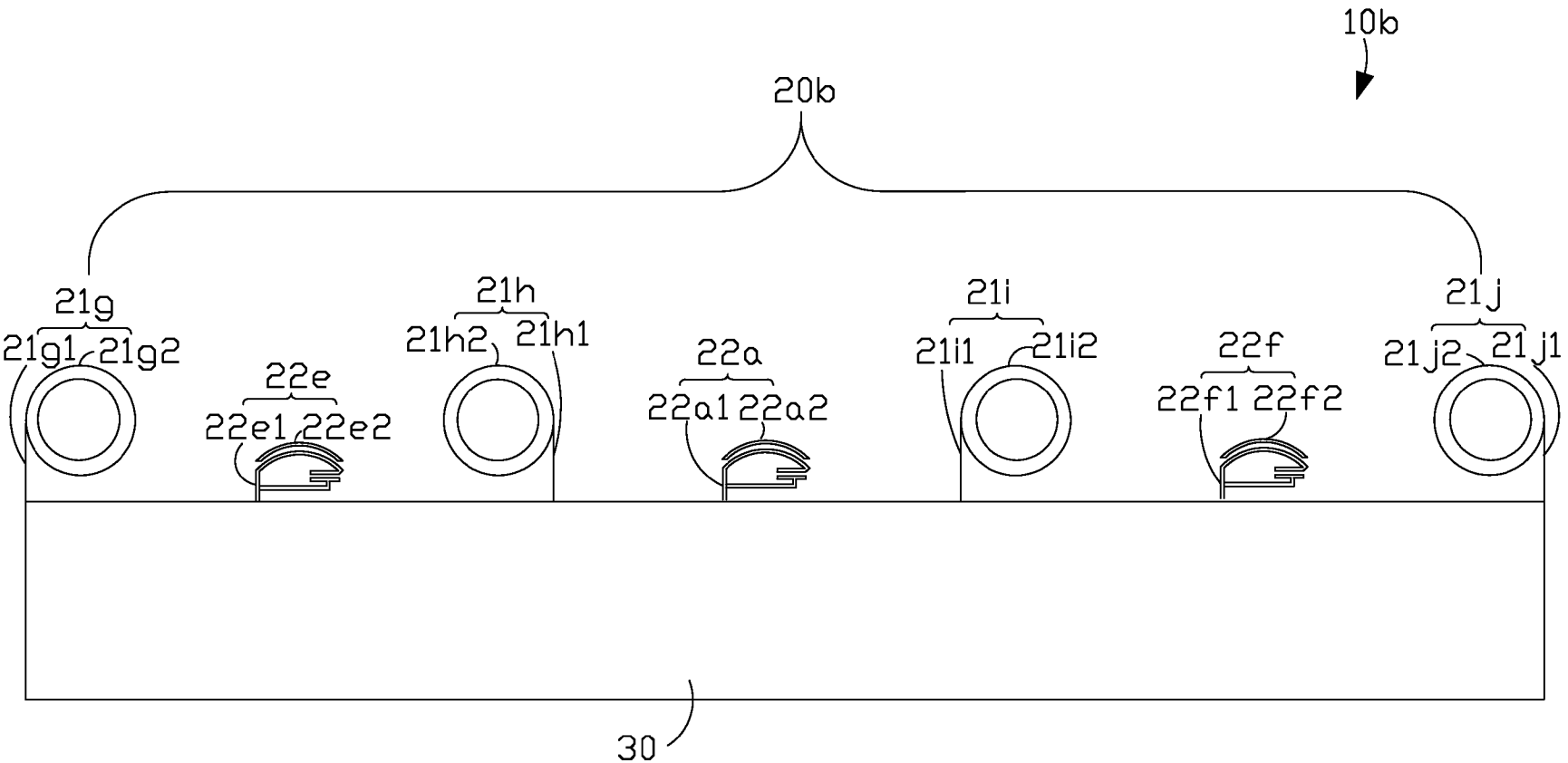
FIG. 6 is a schematic diagram of one embodiment of the MIMO device of FIG. 1.

FIG. 6 is a schematic diagram of one embodiment of a MIMO device 10*b* according to the present disclosure, differing from the MIMO device 10 shown in FIG. 1 only in the further inclusion of a fifth solid antenna 21*h*, a sixth solid antenna 21*i*, a fifth plane antenna 22*e*, and a sixth plane antenna 22*f*. In one embodiment, the solid antennas 21 (*g, h, i, j*) and the plane antennas 22 (*e, a, f*) are configured on the same side of one sidewall of the shielding cover 30.

Referring to FIG. 3 and FIG. 6, the fifth solid antenna 21*h* and the sixth solid antenna 21*i* are the same as or substantially symmetrical to the first solid antenna 21*g* in shape and structure. The fifth solid antenna 21*h* comprises a fifth solid radiator 21*h*2, and a fifth connection section 21*h*1 and a fifth feed line. The sixth solid antenna 21*i* comprises a sixth solid radiator 21*i*2, a sixth connection section 21*i*1, and a sixth feed line.

The plurality of plane antennas 22, such as the fifth plane antenna 22*e*, and the sixth plane antenna 22*f* are the same as the first plane antenna 22*a* in shape and structure. The fifth plane antenna 22*e* comprises a fifth feed portion 22*e*1 and a fifth plane radiator 22*e*2. The sixth plane antenna 22*f* comprises a sixth feed portion 22*f*1 and a sixth plane radiator 22*f*2.

A first connection section 21*g*1, a second connection section 21*j*1, the fifth connection section 21*h*1, the sixth connection section 21*i*1, the first feed portion 22*a*1, a fifth feed portion 22*e*1, and a sixth feed portion 22*f*1 are perpendicular to the same sidewall of the shielding cover 30.

In one embodiment, the connecting portion 40 shown in FIG. 1 may be configured in any location, or the MIMO antenna 20 connected to the other elements directly, obviating the presence of the connecting portion 40 in FIG. 5 and FIG. 6.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A multiple-input multiple-output (MIMO) device, comprising:

a substrate;

a shielding cover, positioned on the substrate and comprising a plurality of sidewalls; and a MIMO antenna, comprising:

a first solid antenna and a second solid antenna, electrically connected to two ends of one sidewall of the shielding cover, respectively;

a third solid antenna and a fourth solid antenna, electrically connected to two ends of another sidewall of the shielding cover;

a first plane antenna configured on the substrate, and disposed between the first solid antenna and the second solid antenna;

wherein the first solid antenna comprises a first feed line, a first connection section and a first solid radiator, and wherein the first connection section comprises a first feed end and a first short end;

wherein the second solid antenna comprises a second feed line, a second connection section and a second solid radiator, and the second solid antenna is substantially symmetrical to the first solid antenna in shape and structure;

wherein the first connection section and the second connection section are connected to the two ends of the one sidewall of the shielding cover, respectively;

wherein the first plane antenna comprises a first plane radiator and a first feed portion;

wherein the third solid antenna comprises a third solid radiator, a third connection section, and a third feed line, and the fourth solid antenna comprises a fourth solid radiator, a fourth connection section, and a fourth feed line;

wherein the third solid antenna and the fourth solid antenna are the same as or substantially symmetrical to the first solid antenna in shape and structure, and connect to two ends of another sidewall of the shielding cover, by the third connection section and the fourth connection section, respectively.

2. The MIMO device as claimed in claim 1, wherein the first solid radiator and the second solid radiator are annular.

3. The MIMO device as claimed in claim 1, wherein the first plane radiator is substantially G shaped.

4. The MIMO device as claimed in claim 3, wherein the shielding cover further comprises a first feed throughway, a second feed throughway, and a third feed throughway, configured on the two ends and middle portion of the one sidewall of the shielding cover, respectively, for the first feed line, the second feed line and the first feed portion to pass through.

5. The MIMO device as claimed in claim 1, wherein the first solid antenna and the second solid antenna are configured on one side of the one sidewall of the shielding cover, and the first plane antenna is on the other side of the sidewall of the shielding cover.

6. The MIMO device as claimed in claim 1, wherein the first plane radiator is grounded by coupling to the one sidewall of the shielding cover.

7. The MIMO device as claimed in claim 1, wherein the MIMO antenna comprises a plurality of plane antennas, the same as or substantially symmetrical to the first plane antenna in shape and structure, and are configured on middle portions of different sidewalls of the shielding cover, respectively.

8. The MIMO device as claimed in claim 7, wherein the first solid antenna, the second solid and the first plane antenna are configured on the same side of the one sidewall of the shielding cover, the third solid antenna, the fourth solid antenna and one of the plurality of plane antennas are configured on another sidewall of the shielding cover.

9. The MIMO device as claimed in claim 8, wherein the MIMO antenna comprises a fifth solid antenna and a sixth solid antenna, the fifth solid antenna comprises a fifth solid radiator, a fifth connection section and a fifth feed line, the sixth solid antenna comprises a sixth solid radiator, a sixth connection section, and a sixth feed line.

10. The MIMO device as claimed in claim 9, wherein the fifth solid antenna and the sixth solid antenna are the same as or substantially symmetrical to the first solid antenna in shape and structure, and configured on the same sidewall with the first solid antenna, the fifth feed line and the sixth feed line pass through corresponding feed throughways of the shielding cover.

11. The MIMO device as claimed in claim 10, wherein the MIMO antenna comprises a plurality of plane antennas, the plurality of plane antennas are the same as the first plane antenna in shape and structure, and configured on the same sidewall of the shielding cover with the first plane antenna, and pass through corresponding feed throughway of the shielding cover.

12. The MIMO device as claimed in claim 11, wherein the first connection section, the second connection section, the fifth connection section, and the sixth connection section are perpendicular to the one sidewall of the shielding cover.

13. A multiple-input multiple-output (MIMO) device, comprising:

a substrate;

a shielding cover positioned on the substrate and comprising a plurality of sidewalls; and a MIMO antenna, comprising:

a first solid antenna and a second solid antenna, electrically connected to two ends of a first sidewall of the shielding cover, respectively; and a third solid antenna and a fourth solid antenna, electrically connected to two ends of a second sidewall of the shielding cover, respectively.

14. The MIMO device as claimed in claim 13, further comprising a plurality of plane antennas configured on middle portions of different sidewalls of the shielding cover, respectively.

* * * * *